US005111553A

United States Patent [19]

Muggeridge et al.

[11] Patent Number: 5,111,553

[45] Date of Patent: May 12, 1992

[54] FLIGHT CONTROL APPARATUS FOR AN ANTI-TANK PROJECTILE

[75] Inventors: David Muggeridge; William F. Ryan; Dieter Haase, all of Phoenix, Ariz.

[73] Assignee: Allied-Signal Inc., Morris Township, Morris County, N.J.

[21] Appl. No.: 589,851

[22] Filed: Sep. 28, 1990

[51] Int. Cl.[5] ..... F42B 10/66

[52] U.S. Cl. ..... 244/3.22; 244/3.28

[58] Field of Search ..... 244/3.22, 3.28, 3.3

[56] References Cited

U.S. PATENT DOCUMENTS 3,390,850 7/1968 Dahlke et al. ..... 244/3.28

*Primary Examiner*—Charles T. Jordan

*Attorney, Agent, or Firm*—Joseph R. Black; James W. McFarland; Robert A. Walsh

[57] ABSTRACT

Flight control apparatus (10) for a cannon-launched anti-tank projectile. A boom that structurally secures four fins (18) and four nozzles (20) to an afterbody (12) of the projectile, and that provides for fluid communication from the afterbody to the nozzles, is provided in the form of an assembly (14) comprising intersecured tubes (22, 24, 26, 28) which define a longitudinal axis (30) of the assembly. The boom assembly (14) considerably reduces the weight and fabrication cost associated with a conventional boom which is provided in the form of an integral multi-channeled cylinder.

9 Claims, 2 Drawing Sheets

FLIGHT CONTROL APPARATUS FOR AN ANTI-TANK PROJECTILE

The present invention relates generally to cannon-launched anti-tank projectiles and more specifically to flight control apparatus therefor.

BACKGROUND OF THE INVENTION

A certain class of cannon-launched, anti-tank projectiles comprises a warhead, an afterbody in communication with the warhead and containing both a solid-fuel propellant and an electrofluidic control mechanism, four fins and roll-control nozzles, and a boom that structurally supports the fins and nozzles to the afterbody and provides channels for fluid communication of the propellant from the afterbody to the nozzles.

As presently implemented, the boom is a one-piece, generally cylindrical member having four axially-extending bores which form the forementioned channels. Between and around the bores is an amount of material which is excessive in view of the two simple functions provided for by the boom. The weight associated with this material can be expected to have a detrimental effect on the range of the projectile. In addition, the design of the boom dictates unnecessarily high material and fabrication costs. This invention is directed to the solution of these problems.

SUMMARY OF THE INVENTION

The invention provides lightweight, low-lost flight control apparatus for an anti-tank projectile. The apparatus comprises the conventional elements of four nozzles, four fins, a fin support member, and a boom. However, in accordance with the invention the boom is provided not as an integral multi-channeled cylinder, but as an assembly comprising four intersecured tubes. This considerably lowers the material and fabrication costs of the boom, and may extend the range of the projectile by significantly reducing its weight.

DESCRIPTION OF THE PREFERRED EMBODIMENT

Figures 1, 3:
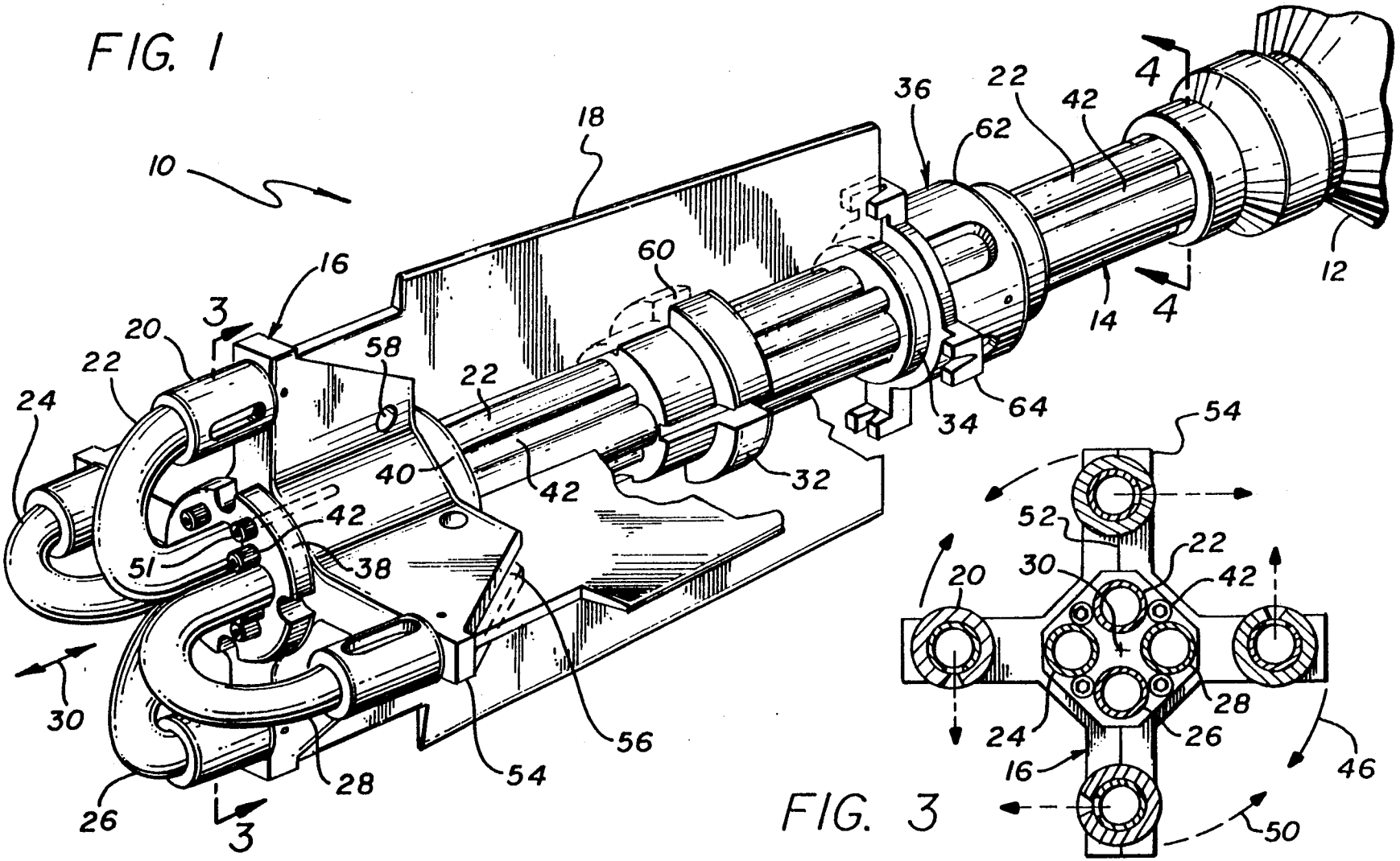
FIG. 1 is a perspective view of the apparatus in accordance with the preferred embodiment thereof, also partially illustrating an afterbody to which the apparatus is secured.
FIG. 3 is a cross-sectional view of the boom assembly, fin support member, and nozzles illustrated in FIG. 1 and is taken along lines 3—3.

Referring to the drawings, the apparatus 10 of the present invention is adapted for securement to an afterbody 12 (partially illustrated) of an anti-tank projectile. The projectile includes a warhead (not shown) secured to and adapted for communication with the afterbody. The apparatus 10 comprises a boom assembly 14, a fin support member 16, four fins (as at 18), and four nozzles (as at 20).

Figures 2, 4:
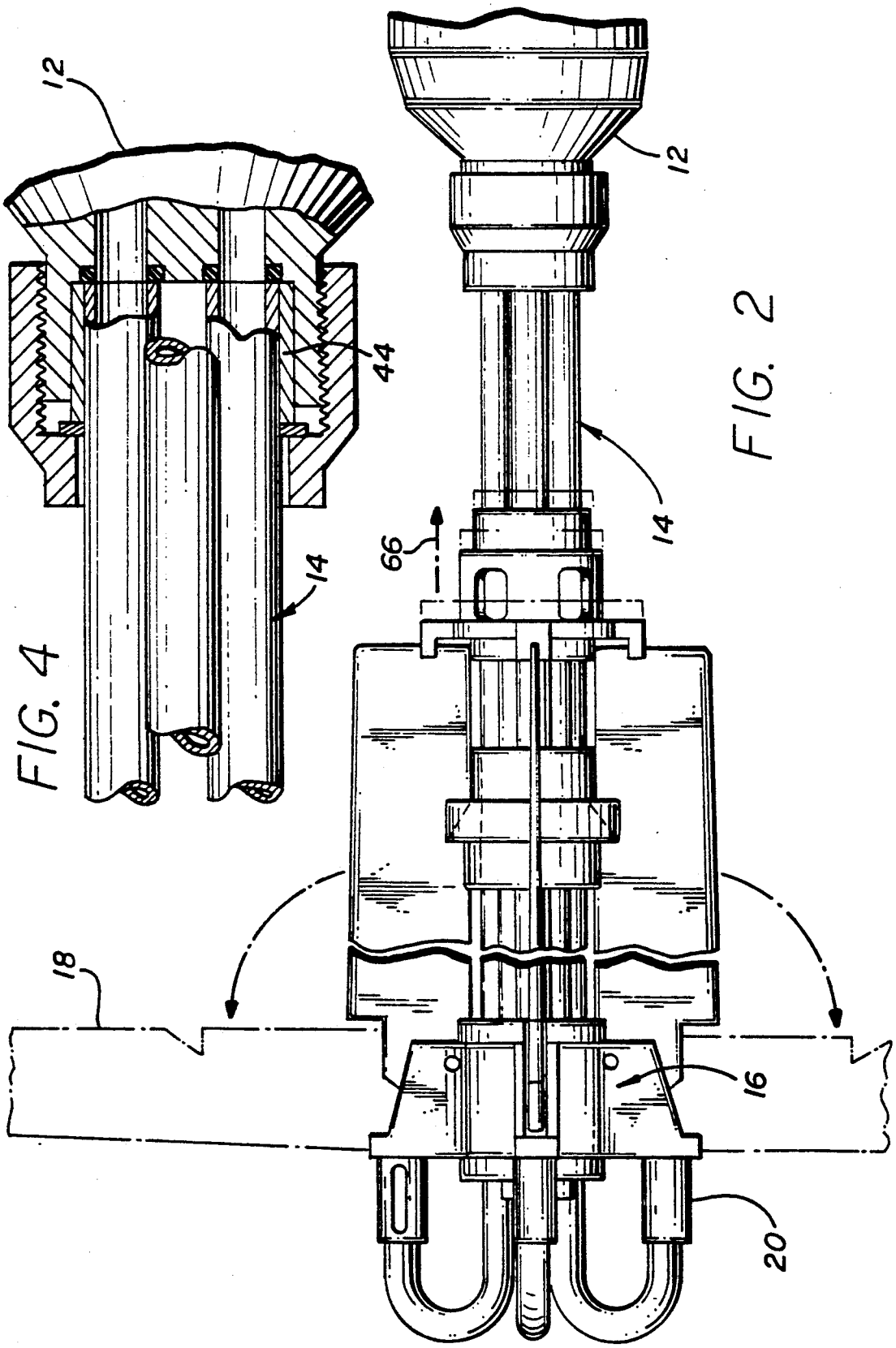
FIG. 2 is an elevational view of the apparatus and afterbody illustrated in FIG. 1.
FIG. 4 is a fragmentary view, partially in elevation and partially in cross-section, illustrating connection of the apparatus to the afterbody of the projectile.

The boom assembly 14 comprises four tubes 22, 24, 26, 28 which collectively define a longitudinal axis 30 of the assembly. As used throughout this description, the term "equiangularly spaced" should be interpreted with respect to a rotational axis which corresponds to the longitudinal axis 30. The tubes are mutually parallel and parallel to the longitudinal axis 30 along at least a majority of the axial length of the assembly 14. The tubes are bent aft of the fin support 16 as indicated so that their aft ends point in the forward direction of the assembly 14, and the tubes are inserted into the nozzles 20 through end walls of the latter. Alternatively, the tubes can be bent only about ninety degrees from the longitudinal axis 30 and inserted into the nozzles 20 through the lateral walls of the latter. After being bent as indicated, the tubes are inserted through a stepped cylinder 32, a cylindrical component 34 of a fin retainer assembly 36, and two fin support retainers 38, 40. Each of these items has two sets of four equiangularly spaced and axially extending bores to accommodate receipt of the four tubes as well as four tubular support members (as at 42). Accordingly, the support members 42 are inserted through the same items as indicated. The support members 42 are of smaller outside diameter than the tubes 22, 24, 26, 28 and are positioned with respect thereto so that each radially adjoins two of the tubes, as illustrated in FIG. 3. The forward ends of the tubes 22, 24, 26, 28 are inserted into a generally cylindrical end piece 44 (FIG. 4). The boom assembly 14, nozzles 20, cylinders 32, 34, and end piece 44 are appropriately positioned and secured in a jig and are brazed together. The tubes 22, 24, 26, 28 are positioned so that the nozzles 20 are equiangularly spaced. The nozzles are positioned in the conventional manner to provide for roll stability of the projectile via thrust control. That is, the nozzles 20 are positioned relative to the longitudinal axis 30 as shown in FIG. 3 so that fluid exiting one opposing pair of nozzles tends to roll the projectile about the axis in one direction 46, while fluid exiting the other opposing pair of nozzles tends to roll the assembly in the opposite direction 50. In operation the relative flow of propellant to the two pairs of nozzles is governed by an electrofluidic pin transducer disposed in the afterbody 12.

After the forementioned brazing step, the fin support 16 is installed between the retainers 38, 40 and secured thereto by screws (as at 51). As is indicated in FIG. 3, the fin support 16 is formed from two equal pieces which are joined at a plane (indicated at 52) parallel to the longitudinal axis 30, and are interconnected by conventional means. The fin support 16 includes four equiangularly spaced projections (as at 54) having slots (as at 56). The fins 18 are inserted in the slots 56 and pivotally secured to the projections 54 by conventional means at locations indicated by the numeral 58. The fins rest as shown in slots (as at 60) formed in a larger-diameter portion of the stepped cylinder 32. The remainder of the fin retainer assembly 36 includes a sleeve 62 secured to a spider 64. The end piece 44 and boom assembly 14 are inserted through the spider 64 and sleeve 62 and are positioned to retain the fins 18 by conventional means including a shear pin (not shown) which connects the spider to the cylindrical component 34. In operation, the shear pin is broken in response to the g-forces accompanying launch, and the same forces cause the sleeve 62 and spider 64 to slide in the direction indicated at 66, whereupon the fins 18 are deployed as indicated in FIG. 2.

The reader should understand that the foregoing portion of the description, which description includes the accompanying drawings, is not intended to restrict the scope of the invention to the preferred embodiment thereof or to specific details which are ancillary to the teaching contained herein. The invention should be given the broadest construction consistent with the following claims and their equivalents.

What is claimed is:

1. Flight control apparatus for a cannon-launched anti-tank projectile, comprising:

a boom assembly having an axial length extending from fore to aft ends of the assembly, the assembly comprising four tubes collectively defining a longitudinal axis of the assembly, the tubes being intersecured such that they are mutually parallel and parallel to the longitudinal axis along at least a majority of the axial length;

a fin support member secured to the boom assembly and radially surrounding an axially-extending portion thereof, the support member having four equiangularly spaced projections extending in a radially outward direction from the assembly;

four fins, each pivotally secured to one of the four projections; and four equiangularly spaced nozzles, each secured to an aft end of one of the four tubes such that it is in fluid communication therewith and spaced from the longitudinal axis, the nozzles collectively being positionally adapted to provide for roll stability of the projectile by thrust control.

2. The invention of claim 1 wherein the tubes are bent aft of the fin support member to an angle of about ninety degrees in a radially outward direction from the longitudinal axis.

3. The invention of claim 2 wherein the tubes are further bent aft of the fin support member to an additional angle of ninety degrees so that the aft ends of the tubes point in the forward direction of the assembly.

4. The invention of claim 2 wherein the nozzles are secured directly to the aft ends of the tubes.

5. The invention of claim 1 wherein the boom assembly further comprises four equiangularly spaced support members, the support members being mutually parallel and parallel to the tubes along substantially their entire lengths, the support members being intersecured with the tubes such that each support member radially adjoins two of the tubes.

6. The invention of claim 5 wherein the tubes are bent aft of the fin support member to an angle of about ninety degrees in a radially outward direction from the longitudinal axis.

7. The invention of claim 6 wherein the tubes are further bent aft of the fin support member to an additional angle of ninety degrees so that the aft ends of the tubes point in the forward direction of the assembly.

8. The invention of claim 7 wherein the nozzles are secured directly to the aft ends of the tubes.

9. The invention of claim 5 wherein the support members are tubular and are of smaller outside diameter than the tubes.

* * * * *